US006972778B2

(12) United States Patent
Shimizu et al.

(10) Patent No.: US 6,972,778 B2
(45) Date of Patent: Dec. 6, 2005

(54) COLOR RE-MAPPING FOR COLOR SEQUENTIAL DISPLAYS

(75) Inventors: Jeffrey A. Shimizu, Cortlandt Manor, NY (US); John Dean, Stormville, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 331 days.

(21) Appl. No.: 10/183,796

(22) Filed: Jun. 27, 2002

(65) Prior Publication Data

US 2004/0008215 A1 Jan. 15, 2004

(51) Int. Cl.[7] ..... G09G 5/10
(52) U.S. Cl. ..... 345/690; 345/77; 345/88
(58) Field of Search ..... 345/87–89, 98–99, 345/204, 600, 601, 690, 605, 589, 77; 348/671–686; 358/455–457

(56) References Cited

U.S. PATENT DOCUMENTS

| | | | | |
|---|---|---|---|---|
| 4,438,453 | A * | 3/1984 | Alston | 358/524 |
| 5,262,847 | A * | 11/1993 | Rodriguez et al. | 348/552 |
| 5,532,763 | A * | 7/1996 | Janssen et al. | 348/744 |
| 6,011,540 | A * | 1/2000 | Berlin et al. | 345/601 |
| 6,285,346 | B1 | 9/2001 | Melnik et al. | 345/87 |
| 6,307,498 | B1 * | 10/2001 | Eglit | 341/155 |
| 6,700,559 | B1 * | 3/2004 | Tanaka et al. | 345/88 |
| 2001/0045927 | A1 | 11/2001 | Zavracky et al. | 345/88 |
| 2002/0030691 | A1 | 3/2002 | McKnight et al. | 345/602 |
| 2002/0051121 | A1 * | 5/2002 | Kanai | 353/85 |

FOREIGN PATENT DOCUMENTS

| | | | |
|---|---|---|---|
| EP | 1054380 A1 | 12/1999 | G09G 3/34 |
| WO | WO9409475 | 10/1993 | G09G 3/36 |
| WO | WO007769 A | 5/2000 | G09G 3/36 |

OTHER PUBLICATIONS

Patent Abstracts of Japan, "Successive Color Display Device for Plane", Sony Corp., Mar. 1995, 08-248381.

* cited by examiner

*Primary Examiner*—Ricardo Osorio
*Assistant Examiner*—Mansour M. Said

(57) ABSTRACT

A color re-mapping method for a sequential display system corrects for slow temporal display response.

4 Claims, 2 Drawing Sheets

COLOR RE-MAPPING FOR COLOR SEQUENTIAL DISPLAYS

FIELD OF TECHNOLOGY

The invention relates to color sequential displays, and more particularly to correcting color errors in color sequential displays due to delay in display response.

BACKGROUND AND SUMMARY

Color sequential displays have emerged as a viable means of achieving both lower cost and improved image quality. But in order to reduce temporal color flash artifacts that can occur in such displays, the frame rate must be significantly increased. This results in short address time thus placing great demands on the temporal response of the display. Color errors arise when display response in color sequential displays is slow.

One promising direction in the display field is the emergence of color sequential liquid crystal on silicon (LcoS) displays, such as taught for example in U.S. Pat. Nos. 5,532,763 and 6,266,105. But in color displays using certain frame presentation frequencies, for example a scrolling color display with a frame rate presentation of 180 Hz, the response time of the liquid crystal is slow and color errors are observed. One solution is to incorporate a black pre-write scheme as taught in U.S. Pat. No. 6,320,565 to Albu, assigned to Philips Electronics North America Corporation. However, even with this type of system there can be a loss of system brightness of about 15% for a well-corrected system. System efficiency is a critical parameter for such a display system, so a solution that reduces brightness is disadvantageous.

Preferred embodiments incorporating the invention utilize a single panel color sequential LCoS system. Some color sequential LCOS systems make use of nematic liquid crystal (LC) effects. With nematic effects an analog voltage is driven to the pixel once per color sub-field. The LC then re-orients due to the voltage change. A limited response time means that the intended brightness value is not achieved. Errors in brightness also arise due to capacitive changes from liquid crystal re-orientation. The result generally is color error.

Solutions are presented to improve operation of color sequential displays, for example to minimize the impact of color errors and/or to compensate for errors by pre-correction of color data, while keeping light loss low. Solutions range from the simple ordering of color presentation to complete re-mapping of color triplets via look up tables.

Accordingly, in one aspect of the invention a method of color re-mapping for color sequential displays includes an input step of inputting triplet values representing respective intensities of first, second, and third color components of an image to be displayed; and a display step of producing the image by temporally sequentially displaying the image in the first color according to the first color intensity, then the second color according to the second color intensity, and then the third color according to the third color intensity, wherein the first color is red, the second color is blue, and the third color is green, so that the blue image is displayed immediately after the red, and the green image is displayed immediately after the blue.

In another aspect of the invention, a method of color re-mapping for color sequential displays includes an input step of inputting triplet values representing respective intensities of first, second, and third color components of an image to be displayed; a display step of producing the image on a display by temporally sequentially displaying the image in the first color based on the first color intensity, then the second color based on the second color intensity, and then the third color based on the third color intensity; and a color correction step for correcting resulting display intensities to conform more accurately to the respective image intensities by correcting for slow temporal display response.

In yet another aspect of the invention, a color sequential display system includes means for inputting triplet values representing respective intensities of first, second, and third color components of an image to be displayed; means for producing the image on a display by temporally sequentially displaying the image in the first color based on the first color intensity, then the second color based on the second color intensity, and then the third color based on the third color intensity; and a computer that corrects resulting display intensities to conform more accurately to the respective image intensities by correcting for slow temporal display response.

BRIEF DESCRIPTION OF THE DRAWING FIGURES

The invention is best described with reference to the following drawing figures, of which:

DETAILED DESCRIPTION

Figure 1:
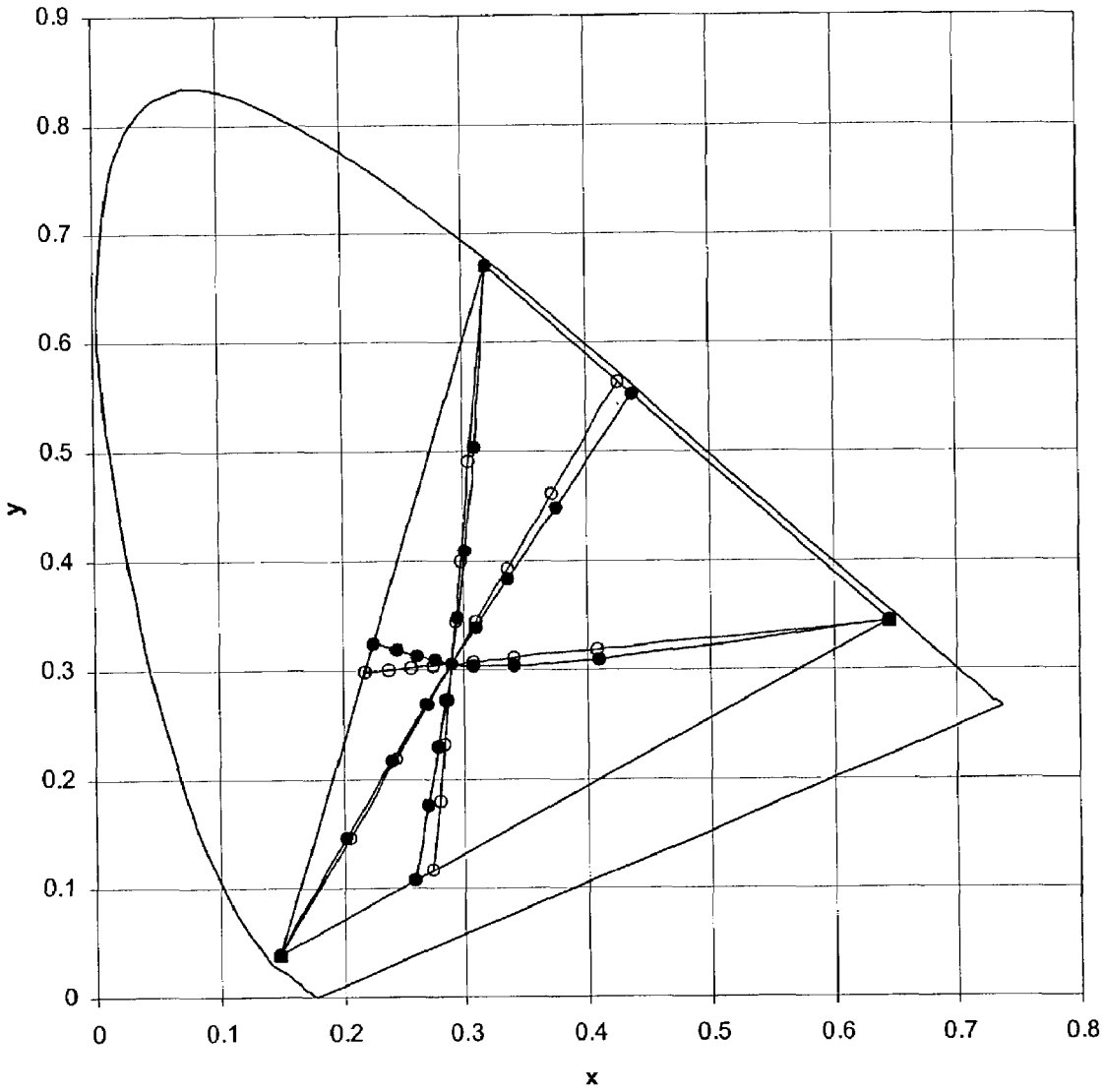
FIG. 1 illustrates color re-mapping as it applies to the invention.

LCOS displays can use a normally white LC effect. That is, with zero voltage the image is white, while at full drive voltage the image is black. Consider the case of displaying a saturated secondary color such as cyan. With a typical color order of red, green, blue, the LCD is driven off for red, on for green, on for blue, and the sequence repeats. The slower transition is relaxation to white. So drive to black achieves an effective shuttering of red. The display then relaxes to the on state for green. This is a slow transition so the amount of green reaching the screen is less than intended.

Next the display is again driven to white. Since the previous state was also white, full transmission of blue is achieved. The net result is more blue reaching the screen than green so the cyan color is skewed towards blue. In general, when one color is significantly less than the other two, the displayed color is skewed towards the color second in the sequence of the two brighter colors.

Projection display systems currently under development may use a high-pressure arc lamp. These lamps tend to be lacking in the red end of the spectrum. We find that natural images are most sensitive to color errors in the yellow-orange region. Especially if colors show an excess of green, the images look poor. So when errors appear it is preferable to push this yellow-orange region towards red, as is accomplished in an embodiment of the invention disclosed herein.

Typically, color sequential systems use a color order of red, green, blue. In this case color errors from limited response speed pushes yellow-orange colors towards green. In an embodiment of the invention disclosed herein we propose using a color order of red, blue, green. With such an order the errors are in the preferred red direction. This color ordering has been implemented in research displays and subjectively better images are produced as a result.

Correct color ordering is an implementation that lessens the impact of color errors. To reduce or eliminate the actual errors we propose that the color data be remapped before presentation to the LCD. The most accurate way of re-mapping is with a full look up table (LUT). For every color triplet (r,g,b) a modified color triplet (r',g',b') would be assigned. So, for example, with a color presentation order of red, green, blue, a cyan color (0,255,255) could be mapped to (0,255,220). With this set of color data green does not achieve full transmission so blue is intentionally reduced to achieve a similar transmission value.

Given a particular display system a full set of color data, translated to (r, g, b), could be measured for every (r',g',b') color input combination. The measured data (r,g,b) represent the achieved color defining the inverse mapping (r,g,b) to (r',g',b'). In a system with 8-bits per color a full look up table of this type would map $256^3$ input values to $256^3$ pre-corrected values. This is a large mapping and thus would require a large amount of memory for the LUT. To reduce the memory load, an alternative would be to use a coarser sampling for the LUT, using interpolation for the color correction data.

To reduce the storage and mapping burdens of a full look up table we alternatively propose mappings based on simple calculated functions of the intensities of the three colors of the respective triplet. While not as accurate as the LUT approach, the errors can be small and certainly an improvement over systems with no correction.

Simple linear arithmetic mappings carry the least computational burden. A simple linear re-mapping of color space can be accomplished through a color matrix approach. In an RGB color order we wish to rotate the color space so that yellows are mapped towards the red. This rotation of color space can be accomplished by a matrix multiplication either on RGB data or at the conversion from YUV to RGB. The disadvantage to this approach is that primary colors will also be remapped. This is undesirable since the display does not create color errors in presentation of the primaries. As an alternative to simple linear arithmetic mapping, non-linear functions of the triplet intensities could be used.

Next is presented an example of a simple mapping that will largely create the desired pre-correction. When the LCD is driven from dark to bright, the display does not respond fast enough so that full brightness is not achieved. To compensate for this we may boost the brightness. However, if that color is already at full brightness this is not possible. So we take a subtractive approach where the brightness of the following color will be reduced. The amount of reduction will depend upon the amount of change from dark to bright.

To implement this simply we introduce the following mapping:

$$x'=x*(1-s*\max(0,x_{-1}-x_{-2}))$$

where x represents the input color value, $x_{-1}$ is the previous color value, $x_{-2}$is the color value before that, s is a scalar reduction factor, and x' is the remapped color. In this equation all color values are normalized to one. For example, suppose for a full black-to-white transition the bright color achieves 85% white. For s=0.15, given a color triplet of (0,1,1), the remapped triplet would be (0,1.0,0.85).

To explain the example further we next examine the mapping of colors on a chromaticity diagram. FIG. 1 shows a mapping according to this example, where the color order is RGB and the reduction factor s=0.15. The open circles represent input colors and adjacent closed circles represent remapped colors. The remapped colors are then driven to the LCD. The color corrections will thereby counteract the color errors that occur because of slow temporal display response, and more accurate color representation will be achieved. The triangle represents the display primary locus. In this example the color order is RGB. Notice how a yellow input is pre-corrected towards the red. Notice also that saturated primaries are unaffected. Also, neutral grays are not affected.

Figure 2:
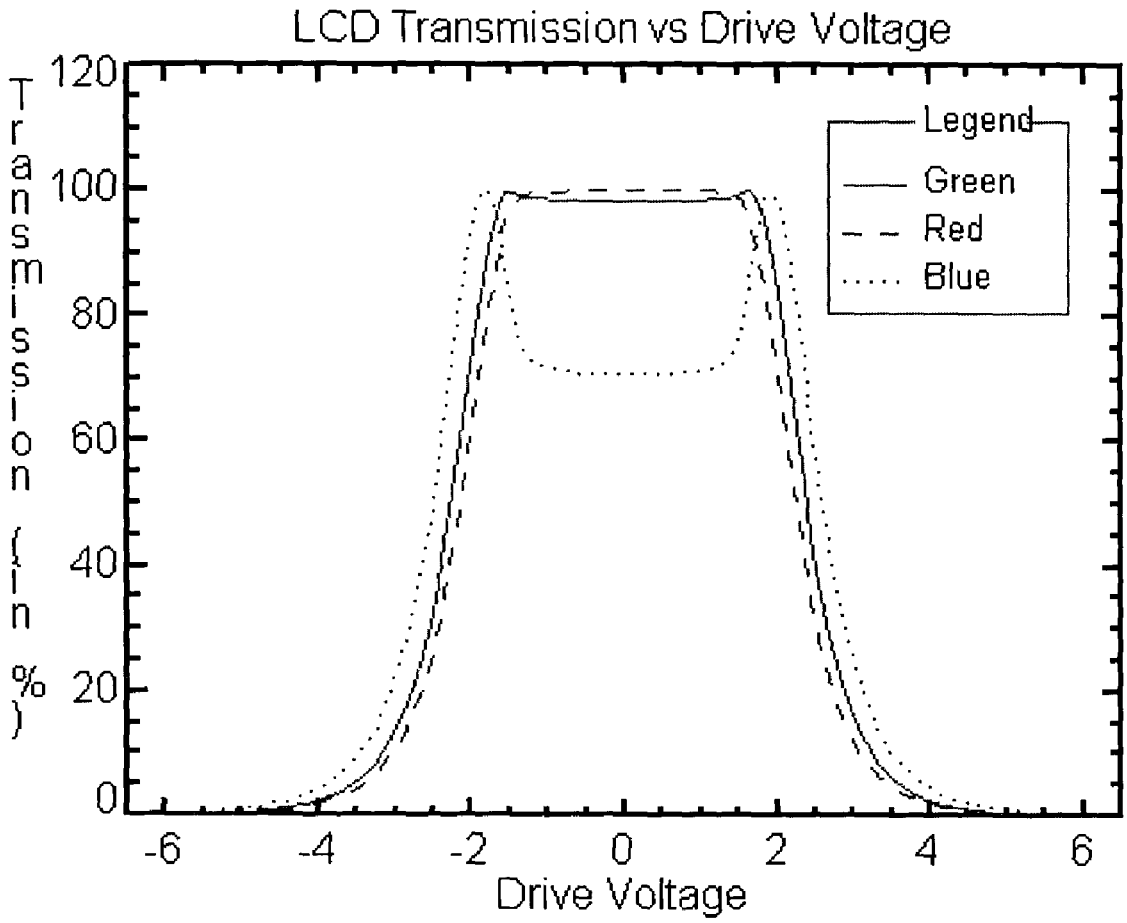
FIG. 2 illustrates LCD brightness versus drive voltage behavior.

Next we examine a mapping that does not use reduction. Instead we allow the signal to go beyond 100%. Typically in a nematic LCoS system, white drive voltage is above zero volts. In an example system the threshold voltage is near 2 volts. This is the voltage at which the LC begins to switch, and the full white voltages are typically near this threshold. FIG. 2 shows a sample plot of LCD brightness versus voltage. If the input brightness exceeds 100% then voltage can be closer to zero. By reducing the voltage of white, the voltage difference with black is increased, which should help the LC achieve full brightness.

An example of a color re-mapping function is:

$$x'=x*(1+s*\max(0,x-x_{-1})).$$

With this mapping only the previous state information is used. In this approach some gray level values must be allocated to inputs greater than 100%. Thus there is some loss in gray scale resolution. The extent to which the increased drive may compensate for brightness loss may be limited. In that case some combined function that both boosts the weak color and reduces the stronger color may be employed. The functions presented here are relatively simple. More complex functions could be implemented to more accurately pre-correct the input signals.

Other embodiments, variations of embodiments, and equivalents, as well as other aspects, objects, and advantages of the invention, will be apparent to those skilled in the art and can be obtained from a study of the drawings, the disclosure, and the appended claims. The term "computer" represents any apparatus that can compute and perform an algorithm, non-exhaustively including large-scale devices, microchips, and everything in between.

We claim:

1. A method of color re-mapping for color sequential displays, comprising:

an input step of inputting triplet values representing respective intensities of first, second, and third color components of an image to be displayed;

a display step of producing the image on a display by temporally sequentially displaying the image in the first color based on the first color intensity, then the second color based on the second color intensity, and then the third color based on the third color intensity; and a color correction step for correcting resulting display intensities to conform more accurately to the respective image intensities by correcting for slow temporal display response, wherein the color correction step includes:

determining a plurality of desired corrected triplet values corresponding to respective input triplet values;

assigning each of the plurality of desired corrected triplet values to its corresponding respective input triplet value in an a priori lookup table; and for every input triplet value received, looking up the corresponding corrected triplet value in the lookup table, and using the corresponding corrected triplet value to drive the display in place of the input triplet value.

2. The color re-mapping method of claim 1, wherein the lookup table is a full lookup table providing correction values for every possible color triplet value.

3. The color re-mapping method of claim 1, wherein the lookup table is a course sampling table, so that a corrected triplet value in the lookup table corresponds to a plurality of different possible input triplet values.

4. The color re-mapping method of claim 1, wherein the lookup table is a course sampling table, and further interpolating corrected triplet values to obtain a calculated corrected triplet value for an input triplet value.

* * * * *